United States Patent [19]

Shinojima

[11] Patent Number: 5,033,936

[45] Date of Patent: Jul. 23, 1991

[54] ROTOR BLADES OF TURBOMOLECULAR PUMP

[75] Inventor: Kazuhiro Shinojima, Narashino, Japan

[73] Assignee: Seiko Seiki Kabushiki Kaisha, Japan

[21] Appl. No.: 397,764

[22] Filed: Aug. 23, 1989

[30] Foreign Application Priority Data

Aug. 24, 1988 [JP] Japan ..... 63-209644

[51] Int. Cl.[5] ..... F01D 1/36; F03B 5/00

[52] U.S. Cl. ..... 415/90; 415/199.5; 416/223 A; 416/238

[58] Field of Search ..... 415/90, 199.4, 199.5; 416/223 R, 234, 223 A, 223 B, 238, 239, 248

[56] References Cited

U.S. PATENT DOCUMENTS

| | | | |
|---|---|---|---|
| 2,313,413 | 3/1943 | Weske | 415/199.4 |
| 3,189,264 | 6/1965 | Becker | 415/90 |
| 3,477,381 | 11/1969 | Becker | 415/90 |
| 3,628,894 | 12/1971 | Ferguson, Jr. | 415/90 |
| 3,826,588 | 7/1974 | Frank | 415/90 |
| 4,309,143 | 1/1982 | Klatt et al. | 415/90 |

FOREIGN PATENT DOCUMENTS

| | | | |
|---|---|---|---|
| 0202396 | 11/1983 | Japan | 415/90 |

*Primary Examiner*—Edward K. Look
*Assistant Examiner*—Hoang Nguyen
*Attorney, Agent, or Firm*—Bruce L. Adams; Van C. Wilks

[57] ABSTRACT

In a turbomolecular pump, the blade angle of each of rotor blades relative to the plane of a rotor gradually decreases from its base toward its outer most periphery, and the opening ratio and relative blade interval of said rotor blades are made substantially constant from the base of the rotor blade to the outer most periphery of said rotor blade.

15 Claims, 4 Drawing Sheets

ROTOR BLADES OF TURBOMOLECULAR PUMP

BACKGROUND OF THE INVENTION

The present invention relates to a turbomolecular pump, and more particularly to rotor blades of a "turbomolecular" pump.

In a conventional turbomolecular pump, such as shown in FIG. 5, a plurality of stator blades 2 are axially disposed on the inner wall surface of a substantially cylindrically shaped casing 1. A rotor 3 is mounted inside the stator blades. A plurality of rotor blades 4 are arranged regularly alternately with the stator blades 2 on the outer wall surface of the rotor 3.

The rotor 3 is held by magnetic bearing means comprised of an axial electromagnet 6 and a radial electromagnet 7 provided on a hollow stator column 5. The rotor 3 is held floated radially and axially by the magnetic bearing means.

The stator column 5 is further equipped with a radio frequency motor 8 to rotate the rotor 3. The axial position and the radial position of the rotor 3 are detected by sensors 9 and 10, respectively. Protective dry bearings 11 and 12 are mounted over and under respectively, the stator column 5 to prevent the magnetic bearing from colliding against the rotor 3 when the magnetic bearing is suddenly de-energized due to power failure or malfunctions of the control circuit.

The rotor 3 is rotated at a high speed to induce streams of gaseous molecules between the successive stator blades 2 and rotor blades 4 to obtain an ultra high vacuum.

In a turbomolecular pump of the type described above, the rotor 3 has slotted rotor discs to form rotor blades 4 as shown in FIG. 6 and FIG. 7. The rotor blades are inclined relative to the plane of the rotor 3 with an optimum blade angle $\alpha$ as shown in FIG. 8 which is constant from the base to the outermost end of the rotor blade 4. The pumping speed is determined by parameters such as opening ratio $\epsilon$, relative blade interval $\lambda$, and the relative speed of gaseous molecules with respect to the revolution speed of the rotor blades, wherein, referring to FIG. 4, the opening ratio $\epsilon$ is defined by $S1/(S1+G)$, and the relative blade interval $\lambda$ is defined by $S2/b$.

In a conventional turbomolecular pump, only one rotor blade angle which is optimum at one point along the radial length of a rotor blade is selected. Rotor blades are then formed with this constant rotor blade angle. Since the blade angle is constant, the above parameters change along the rotor blade depending upon the distance from the center of the rotor 3. Even though the blade angle and the parameters are optimum at one point along the rotor blade, they are not optimum at other points, e.g. near the base or the outermost end of the blade. Therefore, the uniform blade angle does not produce an optimum pumping speed along the whole length of the rotor blades.

SUMMARY OF THE INVENTION

It is therefore an object of the present invention to improve the pumping efficiency of rotor blades in a turbomolecular pump. It is another object of the present invention to provide parameters such as rotor blade angle, opening ratio of the rotor blades and relative blade interval of the rotor blades which are optimum relative to the rotational speed at every location from the base to the front end of each rotor blade.

PREFERRED EMBODIMENT OF THE INVENTION

Figure 1:
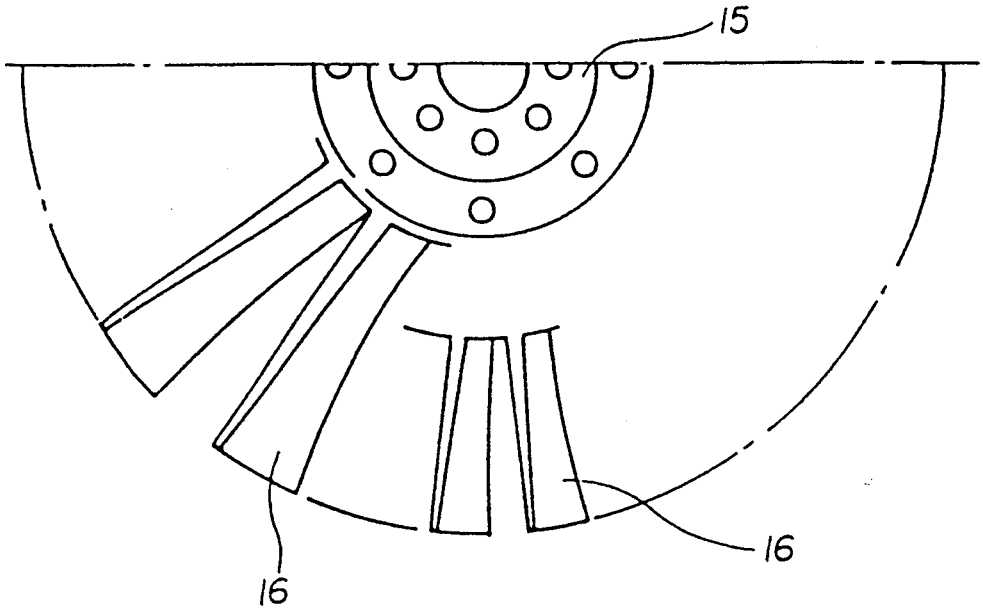
FIG. 1 is a schematic plan view of a half of a rotor.
Figure 2:
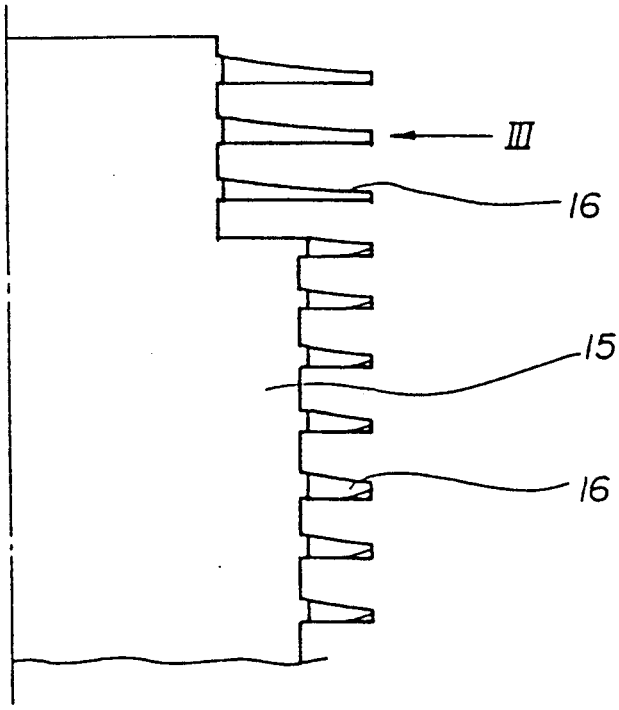
FIG. 2 is a schematic front elevation of the half of the rotor.
Figure 3:
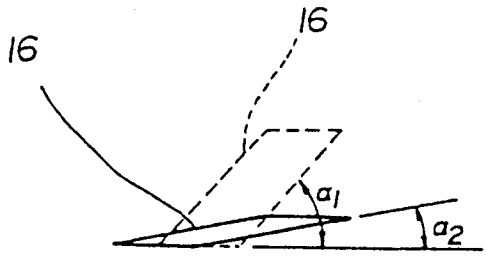
FIG. 3 is a view taken along line III of FIG. 2.
Figure 4:
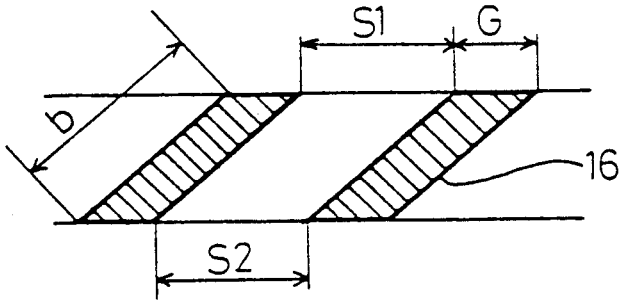
FIG. 4 schematically shows a simplified structure of the single blade row in a turbomolecular pump.

FIGS. 1 to 3 illustrate a rotor 15 provided with rotor blades 16 whose blade angle decreases gradually from the base toward the front end of each blade. In this embodiment, all the parameters such as the rotor blade angle, opening ratio of rotor blades and relative blade interval are optimum relative to the rotational speed at every location along the whole length of rotor blades. In particular, as shown in FIG. 3, the base of each rotor blade 16 is shaped as indicated by the dotted line, and the blade angle $\alpha_1$ for example 45°. The front end is shaped as indicated by the solid line, and the blade angle $\alpha_2$ is for example 10°.

In the embodiment according to the present invention, the opening ratio and relative rotor blade interval are made substantially constant at every location from the base to the outermost end of the rotor blades by gradually radially decreasing the rotor blade angle.

The opening ratio and the relative rotor blade interval are therefore optimized relative to the rotating speed of the rotor blades at every location from its base to its outermost end portion. The novel rotor blades 16 can increase the pumping speed by about 20% as compared with the pumping speed obtained by the prior art pump. In other words, by the use of the novel rotor blades 16, a desired vacuum is attained faster.

Figure 5:
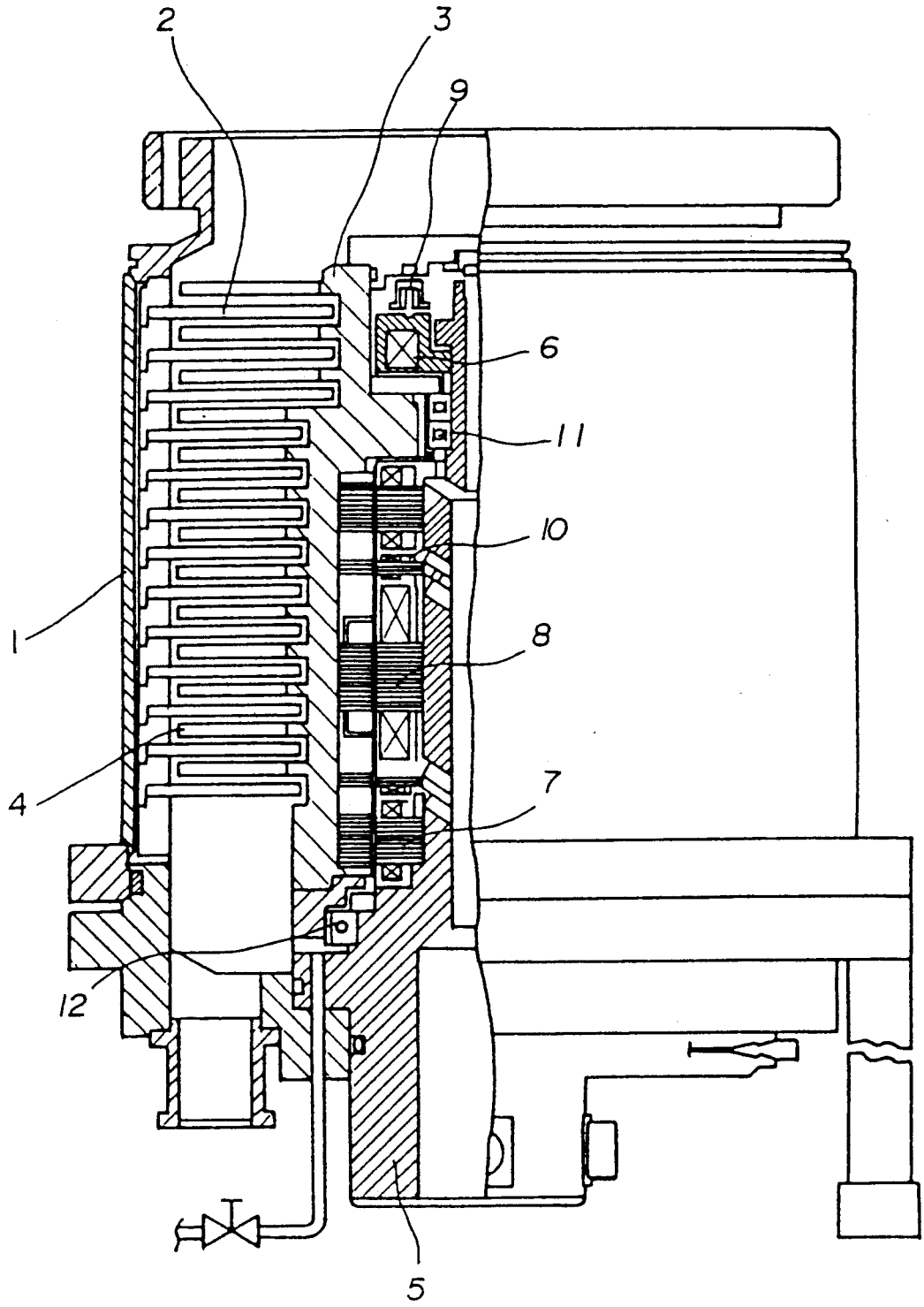
FIG. 5 is a partially cutaway front elevation of a conventional turbomolecular pump.
Figure 6:
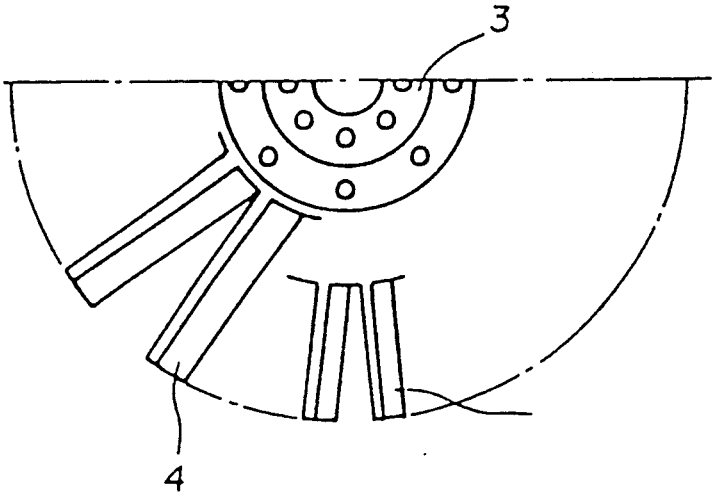
FIG. 6 PRIOR ART
FIG. 6 is a schematic plan view of a half of the rotor in a conventional turbomolecular pump.
Figure 7:
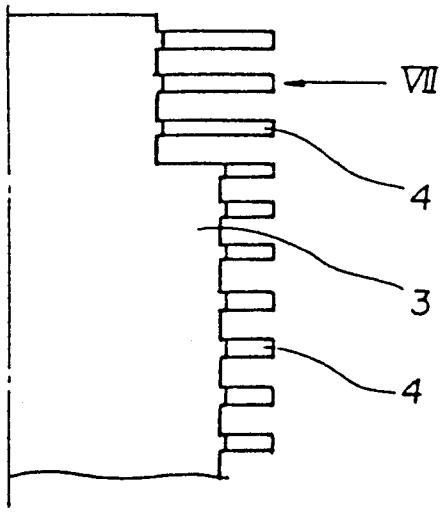
FIG. 7 PRIOR ART
FIG. 7 is a front elevation of the half of the rotor in a conventional turbomolecular pump.
Figure 8:
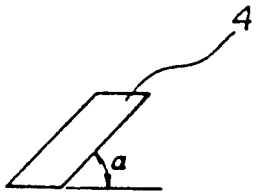
FIG. 8 PRIOR ART
FIG. 8 is a view taken along line VII of FIG. 7.

In this embodiment, the novel rotor blades are applied to an outer rotor type turbomolecular pump such as shown in FIG. 5. However, it is no doubt that the novel rotor blades are also applicable to turbomolecular pump of other types such as an inner rotor type turbomolecular pump in which a rotor shaft coupled to a rotor is rotatably held inside a stator column.

According to the present invention, all the parameters such as the rotor blade angle, opening ratio of rotor blades and relative blade interval are optimum relative to the rotational speed at every location along the whole length of rotor blades. This structure results in the increase in the pumping speed and consequently improves the pump performance.

What is claimed is:

1. A turbomolecular pump comprising:

a casing;

stator blades provided on the inner wall surface of said casing;

a rotor mounted inside said casing, the rotor having a rotor shaft; and a plurality of rotor blades mounted on the outer wall surface of said rotor and disposed to have opening ratios and relative blade intervals being substantially constant from their bases to their outermost peripheries, each of said rotor blades having a rotor blade angle relative to the plane of said rotor which gradually decreases from the base toward the outermost periphery thereof;

said stator blades and said rotor blades being alternately arranged in the axial direction of said rotor, and either of said rotor and said rotor shaft being rotatably held by a stator column.

2. A turbo-molecular pump according to claim 1; wherein each of said rotor blades has a rotor blade width which gradually increases from the base toward the outermost periphery thereof.

3. A turbo-molecular pump according to claim 1; wherein each of said rotor blades has a rotor blade height substantially constant from the base toward the outermost periphery thereof.

4. A turbo-molecular pump comprising:

a casing having an opening for admitting gas molecules;

a stator disposed inside the casing and carrying a plurality of radially extending stator blades; and a rotationally driven rotor disposed inside the casing and carrying a plurality of radially extending rotor blades and coacting with the stator blades to pump gas molecules through the casing in response to rotation of the rotor, each rotor blade extending radially from the rotor and being twisted lengthwise along a radial axis thereof such that the base of each rotor blade is disposed at a maximum angle relative to a plane containing the rotor and the outermost end of each rotor blade is disposed at a minimum angle relative to the plane containing the rotor.

5. A turbo-molecular pump according to claim 4 further comprising axial detecting means for detecting displacement of the rotor in an axial direction and radial detecting means for detecting displacement of the rotor in a radial direction with respect to the axis of the rotor.

6. A turbo-molecular pump according to claim 4; wherein stator blades include stator blades of at least two different lengths.

7. A turbo-molecular pump according to claim 4; including magnetic bearing means for magnetically holding the rotor ar a predetermined position inside the casing such that the rotor does not touch the casing.

8. A turbo-molecular pump according to claim 7; wherein the magnetic bearing means comprises at least one axial electromagnet to hold the rotor in an axial direction and at least one radial electromagnet to hold the rotor in a radial direction.

9. A turbo-molecular pump according to claim 4; wherein the casing comprises a generally cylindrical casing.

10. A turbo-molecular pump according to claim 4; wherein the rotor blades have opening ratios that are substantially constant from the bases to the outermost ends of the rotor blades.

11. A turbo-molecular pump according to claim 4; wherein the rotor blades have relative blade intervals that are substantially constant from the bases to the outermost ends of the rotor blades.

12. A turbo-molecular pump according to claim 4; wherein the rotor blades have opening ratios and relative blade intervals that are substantially constant from the bases to the outermost ends of the rotor blades.

13. A turbo-molecular pump according to claim 12; wherein each rotor blade has a blade width which gradually increases from the base to the outermost end thereof.

14. A turbo-molecular pump according to claim 12; wherein each rotor blade has a height which is substantially constant from the base to the outermost end thereof.

15. A turbo-molecular pump according to claim 12; wherein the base of each rotor blade is disposed at an angle of 45° to the plane of the rotor and the outermost end of each rotor blade is disposed at an angle of 10° to the plane of the rotor.

* * * * *